US007333744B2

(12) United States Patent
Shimojo et al.

(10) Patent No.: US 7,333,744 B2
(45) Date of Patent: Feb. 19, 2008

(54) IMAGE FORMING APPARATUS THAT CHARGES A PHOTOSENSITIVE MEMBER BY SUPERIMPOSING AN ALTERNATE CURRENT BIAS VOLTAGE ON A DIRECT CURRENT BIAS VOLTAGE AS THE CHARGE BIAS VOLTAGE

(75) Inventors: Eiji Shimojo, Tokyo (JP); Haruji Mizuishi, Tokyo (JP); Tokuya Ojimi, Kanagawa (JP); Masanori Kawasumi, Kanagawa (JP); Takuzi Yoneda, Tokyo (JP); Ken Amemiya, Tokyo (JP); Takatsugu Fujishiro, Tokyo (JP); Hiroshi Ono, Tokyo (JP); Toshio Koike, Kanagawa (JP); Masami Tomita, Shizuoka (JP); Yuji Arai, Kanagawa (JP); Takeshi Uchitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 146 days.

(21) Appl. No.: 11/289,488

(22) Filed: Nov. 30, 2005

(65) Prior Publication Data

US 2006/0133837 A1 Jun. 22, 2006

(30) Foreign Application Priority Data

Nov. 30, 2004 (JP) ..... 2004-345972

(51) Int. Cl.
*G03G 15/00* (2006.01)
*G03G 21/00* (2006.01)

(52) U.S. Cl. ..... 399/71; 399/82; 399/343; 399/346; 430/110.3; 430/110.4; 430/126.2

(58) Field of Classification Search ..... 399/71, 399/82, 343, 346, 347; 430/126.2, 110.1, 430/110.3, 110.4, 111.4
See application file for complete search history.

(56) References Cited

U.S. PATENT DOCUMENTS 4,562,136 A 12/1985 Inoue et al. ..... 430/108.23
4,758,489 A 7/1988 Tomita et al. ..... 430/108.23

(Continued)

FOREIGN PATENT DOCUMENTS

JP 2-191980 7/1990

(Continued)

OTHER PUBLICATIONS

U.S. Appl. No. 06/471,387, filed Mar. 2, 1983, Satoru Inoue.

(Continued)

*Primary Examiner*—Sophia S. Chen
(74) *Attorney, Agent, or Firm*—Oblon, Spivak, McClelland, Maier & Neustadt, P.C.

(57) ABSTRACT

A charge apparatus charges by uniformly superimposing an alternate current bias voltage with a fixed frequency over a direct current bias voltage as the charge bias voltage on a photosensitive member. An exposure apparatus exposes the surface of the charged photosensitive member based on image data, and writes a latent image, and a developing apparatus supplies toner to and makes visible the latent image formed on the surface of the photosensitive member. A transfer apparatus transfers the visible image on the photosensitive member to a transfer medium, and a cleaning apparatus cleans the surface of the photosensitive member after transfer.

15 Claims, 6 Drawing Sheets

U.S. PATENT DOCUMENTS

| | | | | |
|---|---|---|---|---|
| 4,762,763 | A | 8/1988 | Nomura et al. | 430/108.3 |
| 4,888,263 | A | 12/1989 | Tomita et al. | 430/108.3 |
| 4,931,374 | A | 6/1990 | Tomita et al. | 430/106.2 |
| 5,164,774 | A | 11/1992 | Tomita et al. | 399/284 |
| 5,225,303 | A | 7/1993 | Tomita et al. | 430/108.4 |
| 5,244,765 | A | 9/1993 | Katoh et al. | 430/108.8 |
| 5,339,141 | A | 8/1994 | Suzuki et al. | 399/285 |
| 5,384,628 | A | 1/1995 | Takami et al. | 399/255 |
| 5,424,814 | A | 6/1995 | Suzuki et al. | 399/284 |
| 5,474,869 | A | 12/1995 | Tomita et al. | 430/102 |
| 5,721,083 | A | 2/1998 | Masuda et al. | 430/108.3 |
| 5,840,456 | A | 11/1998 | Tomita et al. | 430/109.1 |
| 5,857,132 | A | 1/1999 | Mizuishi et al. | 399/66 |
| 5,873,019 | A | 2/1999 | Mizuishi | 399/313 |
| 6,074,794 | A | 6/2000 | Fushimi et al. | 430/109.2 |
| 6,103,441 | A | 8/2000 | Tomita et al. | 430/110.4 |
| 6,128,449 | A | 10/2000 | Zenba et al. | 399/50 |
| 6,226,481 | B1 | 5/2001 | Yoneda et al. | 399/227 |
| 6,507,718 | B2 | 1/2003 | Ohjimi et al. | 399/127 |
| 6,660,443 | B2 | 12/2003 | Sugiyama et al. | 430/108.4 |
| 6,682,866 | B2 | 1/2004 | Sugiyama et al. | 430/108.1 |
| 6,740,460 | B2 | 5/2004 | Tomita et al. | 430/109.4 |
| 6,787,280 | B2 | 9/2004 | Yamashita et al. | 430/111.4 |
| 6,800,412 | B2 | 10/2004 | Sugiyama et al. | 430/108.1 |
| 6,824,945 | B2 | 11/2004 | Emoto et al. | 430/137.15 |
| 6,835,519 | B2 | 12/2004 | Sugiyama et al. | 430/109.4 |
| 6,846,604 | B2 | 1/2005 | Emoto et al. | 430/110.3 |
| 6,849,369 | B2 | 2/2005 | Yagi et al. | 430/110.4 |
| 6,852,462 | B2 | 2/2005 | Emoto et al. | 430/109.4 |
| 6,873,814 | B2 | 3/2005 | Ohjimi et al. | 399/252 |
| 6,936,390 | B2 | 8/2005 | Nanya et al. | 430/108.22 |
| 2001/0044059 | A1 | 11/2001 | Miyamoto et al. | 430/45.54 |
| 2002/0098436 | A1 | 7/2002 | Miyamoto et al. | 430/110.3 |
| 2003/0027066 | A1 | 2/2003 | Yamashita et al. | 430/105 |
| 2003/0055159 | A1 | 3/2003 | Yamashita et al. | 430/105 |
| 2003/0077536 | A1 | 4/2003 | Yamashita et al. | 430/110.3 |
| 2003/0096185 | A1 | 5/2003 | Yamashita et al. | 430/109.4 |
| 2004/0053154 | A1 | 3/2004 | Tomita et al. | 430/109.4 |
| 2004/0076901 | A1 | 4/2004 | Miyamoto et al. | 430/110.3 |
| 2004/0106057 | A1 | 6/2004 | Tomita et al. | 430/108.6 |
| 2004/0131961 | A1 | 7/2004 | Watanabe et al. | 430/108.4 |
| 2004/0142265 | A1 | 7/2004 | Tomita et al. | 430/108.4 |
| 2004/0157146 | A1 | 8/2004 | Tomita et al. | 430/108.9 |
| 2004/0175641 | A1 | 9/2004 | Nanya et al. | 430/109.4 |
| 2004/0209181 | A1 | 10/2004 | Higuchi et al. | 430/108.4 |
| 2004/0229147 | A1 | 11/2004 | Higuchi et al. | 430/110.3 |
| 2005/0025520 | A1* | 2/2005 | Murakami et al. | 399/346 X |
| 2005/0036805 | A1 | 2/2005 | Murakami et al. | 399/149 |
| 2005/0074264 | A1* | 4/2005 | Amemiya et al. | 399/346 |
| 2005/0112488 | A1 | 5/2005 | Yamada et al. | 430/108.7 |
| 2005/0164114 | A1 | 7/2005 | Yagi et al. | 430/110.1 |
| 2005/0186498 | A1 | 8/2005 | Honda et al. | 430/110.3 |
| 2005/0208408 | A1 | 9/2005 | Uchinokura et al. | 430/108.21 |
| 2005/0250036 | A1 | 11/2005 | Emoto et al. | 430/109.2 |
| 2005/0260516 | A1 | 11/2005 | Tomita et al. | 430/110.3 |
| 2006/0045592 | A1* | 3/2006 | Shirodai et al. | 399/346 |

FOREIGN PATENT DOCUMENTS

| | | |
|---|---|---|
| JP | 2000-147953 | 5/2000 |
| JP | 2001-22225 | 1/2001 |

OTHER PUBLICATIONS

U.S. Appl. No. 06/675,329, filed Nov. 27, 1984, Hisao Murayama.
U.S. Appl. No. 06/825,998, filed Feb. 4, 1986, Toshiki Nanya.
U.S. Appl. No. 07/668,487, filed Mar. 13, 1991, Koichi Katoh.
U.S. Appl. No. 07/691,348, filed Apr. 25, 1991, Masami Tomita.
U.S. Appl. No. 08/128,048, filed Sep. 27, 1993, Masami Tomita.
U.S. Appl. No. 09/384,797, filed Aug. 27, 1999, Satoru Miyamoto.
U.S. Appl. No. 10/652,505, filed Sep. 2, 2003, Murakami et al.
U.S. Appl. No. 10/645,804, filed Aug. 22, 2003, Tomita et al.
U.S. Appl. No. 11/512,385, filed Aug. 30, 2006, Tomita.
U.S. Appl. No. 11/734,895, filed Apr. 13, 2007, Yamashita et al.

* cited by examiner

IMAGE FORMING APPARATUS THAT CHARGES A PHOTOSENSITIVE MEMBER BY SUPERIMPOSING AN ALTERNATE CURRENT BIAS VOLTAGE ON A DIRECT CURRENT BIAS VOLTAGE AS THE CHARGE BIAS VOLTAGE

BACKGROUND OF THE INVENTION

1. Field of the Invention

The present invention relates to an image forming apparatus using an electronic photographic process such as a copier, printer or facsimile device, etc, and more particularly, to an image forming apparatus that comprises a charge apparatus that charges by superimposing an alternate current bias voltage on a direct current bias voltage as the charge bias voltage.

2. Description of the Background Art

The image forming apparatus in this type of electronic photographic system forms a toner image by: the charge apparatus discharging to the surface of a photosensitive member, which is the image support member; conducting charge processing by applying a charge of a specified polarity; forming an electrostatic latent image by exposing the surface of the charged photosensitive member; and the developing apparatus supplying to this electrostatic latent image toner that is charged in the same polarity as the charge polarity. The toner image formed on the photosensitive member is next transferred to recording paper, etc., and is fixed on the recording paper by heat and pressure.

Recent charge apparatuses have a charge roller, which is a conductive member formed in a roller-shape that contacts or nearly contacts the surface of a photosensitive member, and charges the surface of the photosensitive member by applying voltage between the charge roller and the photosensitive member when in proximity. These charge apparatuses have the advantages of low ozonization and low power consumption, and are often used as the method to charge the surface of the photosensitive member.

In order to conduct charge processing of the surface of the photosensitive member more uniformly, a system has been adopted in which a charge bias is applied that superimposes alternate current (AC) voltage on direct current (DC) voltage. Compared to DC only charge systems, the image forming apparatuses using this system must run a large AC current in order to obtain the desired charge potential, and it necessary to make the AC frequency at this time n times (n is an integer) or more the linear velocity of the photosensitive member. For example, if we let n=7, then with a photosensitive member linear speed of 100 mm/sec, 100×7, or 700 Hz or more is necessary. If not more than n times, then AC frequency jitters may be observed as halftone images in the uniform intermediate potential image. Consequently, if multiple photosensitive linear velocities are provided within one image forming apparatus, then the same kind of charge capacity can be obtained by making AC frequencies that match the various linear velocities.

However, it is necessary to provide a frequency conversion circuit in the power source unit of the charge apparatus when matching the linear velocity of the photosensitive member and varying the AC frequency, and this part raises the costs. Moreover, if fixed at the frequency necessary during the highest linear velocity, then jitters do not occur even during the lower linear velocities, but the excess discharge during low linear velocity is the cause of the adhesion, etc. of ozone-components, and produces filming on the surface of the photosensitive member. When filming forms on the surface of the photosensitive member, it becomes difficult to attenuate (lower) the superficial potential even if exposing to irradiated light, and the more the amount of attenuation is reduced the more laminated layers (thickness) of filming substance there are. As a result, the potential on the photosensitive member after exposure increases in conjunction with the increase of filming substance, specifically, the residual potential becomes notable and causes production of unsatisfactory images having scum, etc.

Thus, the following technology has been disclosed in order to eliminate filming.

For example, disclosed in Japanese Unexamined Patent Application Publication No. 2001-22225 and Japanese Unexamined Patent Application Publication No. 2000-147953 are technologies that detect filming on the photosensitive member using a surface potentiometer, and use a filming removal device to eliminate filming substance. Moreover, disclosed in Japanese Unexamined Patent Application Publication No. H2-191980 is a filming removal device that performs as a film removal action one cycle of filming removal when the main switch is thrown after processing a set number of pages.

Nonetheless, mounting surface potentiometers and filming removal devices increases the size of the configuration of the image forming apparatus, and raises the costs. Further, it is necessary to have a mechanism to prevent the occurrence of filming because it is extremely difficult to remove filming once films have formed on the photosensitive member.

SUMMARY OF THE INVENTION

Addressing the aforementioned problems, an object of the present invention is to offer an image forming apparatus that can prevent the production of filming using the simplest possible configuration, even if multiple photosensitive member linear velocities are provided and the AC frequency of the charge apparatus has been fixed.

In accordance with an aspect of the present invention, an image forming apparatus has a plurality of photosensitive member linear velocities and comprises a charge apparatus that charges by uniformly superimposing on a photosensitive member an alternate current bias voltage with a fixed frequency over a direct current bias voltage as the charge bias voltage; an exposure apparatus that exposes the surface of the charged photosensitive member based on image data, and writes a latent image; a developing apparatus that supplies toner to and makes visible the latent image formed on the surface of the photosensitive member; a transfer apparatus that transfers the visible image on the photosensitive member to a transfer medium; and a cleaning apparatus that cleans the surface of the photosensitive member after transfer. The image forming apparatus comprises a filming removal mode that removes filming on the surface of the photosensitive member and the filming removal mode is selected corresponding to the plurality of photosensitive member linear velocities.

In accordance with another aspect of the present invention, a toner is supplied in the developing process of a image forming apparatus of an electronic copier system. The volume average particle diameter is 3 to 8 μm, and the ratio (Dv/Dn) of the volume average particle diameter (Dv) and the number average particle diameter (Dn) is in the range of 1.00 to 1.40. The image forming apparatus has a plurality of photosensitive member linear velocities and comprises a charge apparatus that charges by uniformly superimposing on a photosensitive member an alternate current bias voltage with a fixed frequency over a direct current bias voltage as the charge bias voltage; an exposure apparatus that exposes the surface of the charged photosensitive member based on image data, and writes a latent image; a developing apparatus that supplies toner to and makes visible the latent image formed on the surface of the photosensitive member; a transfer apparatus that transfers the visible image on the photosensitive member to a transfer medium; and a cleaning apparatus that cleans the surface of the photosensitive member after transfer. The image forming apparatus comprises a filming removal mode that removes filming on the surface of the photosensitive member and the filming removal mode is selected corresponding to the plurality of photosensitive member linear velocities.

BRIEF DESCRIPTION OF THE DRAWINGS

The above and other objects, features and advantages of the present invention will become more apparent from the following detailed description taken with the accompanying drawings in which:

FIG. 4 is a diagram indicating a ranking of the filming produced at every cumulative number of pages passing through;

DESCRIPTION OF THE PREFERRED EMBODIMENTS

Embodiments related to the present invention will be explained below based on the diagrams.

Figure 1:
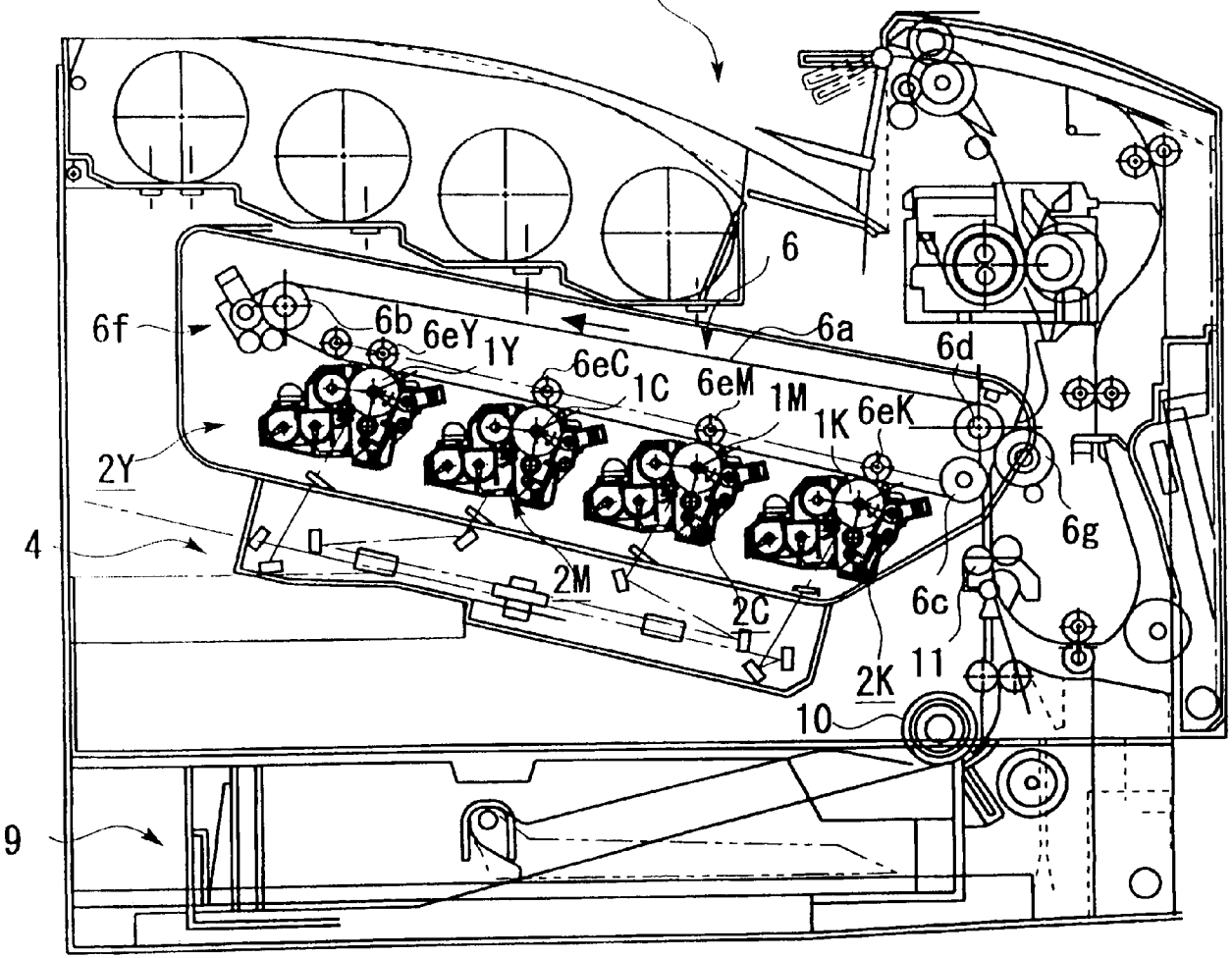
FIG. 1 is a schematic diagram indicating the configuration of an image forming apparatus related to an embodiment of the present invention.

A schematic configuration of an image forming apparatus related to the present embodiment is indicated in FIG. 1. Here, an embodiment will be explained as applied to an image forming apparatus 100 of an electronic photographic system. This image forming apparatus 100 is an image forming apparatus 100 to form color images (called "tandem type" hereafter) from the four toner colors of yellow (called "Y" hereinafter), cyan (called "C" hereinafter), magenta (called "M" hereinafter), and black (called "K" hereinafter). This image forming apparatus 100 provides four photosensitive members 1Y, 1C, 1M, and 1K as latent image support members. The photosensitive members 1Y, 1C, 1M, and 1K are rotationally driven in the direction of the arrow in the diagram while making contact respectively with the intermediate transfer belt 6*a* , which is a surface movement member.

Figure 2:
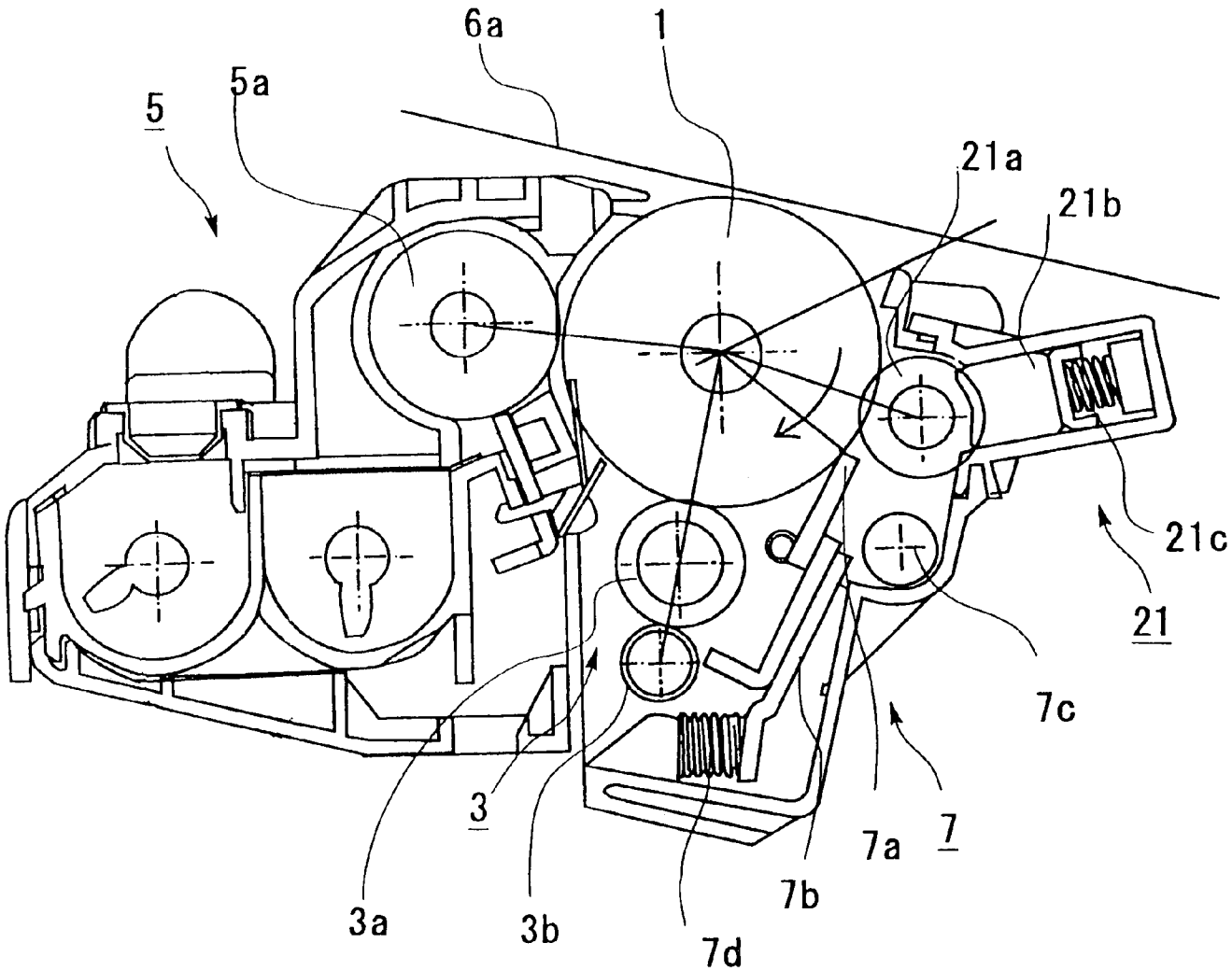
FIG. 2 is diagram indicating a schematic configuration of an image formation unit in which the photosensitive member of this image forming apparatus is arranged.

FIG. 2 indicates a schematic configuration of an image formation unit in which the photosensitive member is arranged. Further, only one of the image formation units 2 is indicated in the diagram because the configuration around the photosensitive members 1Y, 1C, 1M and 1K in all the image formation units 2Y, 2C, 2M, and 2K is the same, and the codes Y, C, M, and K for the colors have been omitted. Arranged around the photosensitive member 1 in order along the direction of the surface movement are a developing apparatus 5 that makes the latent image visible and forms the toner image, a lubricant coating apparatus 21 that coats lubricant on the photosensitive member 1, a cleaning device 7 that cleans the residual toner on the photosensitive member 1, and a charge apparatus 3 that charges the photosensitive member 1.

The configuration of the image forming apparatus 100 of the present embodiment will be explained based on FIGS. 1 and 2.

A development apparatus 5, which is the developer support member, is partially exposed from an opening in the casing of a development roller 5*a*. Here, a dual component developer comprising a toner and a carrier is used, but a single component developer not containing a carrier may also be used. The corresponding color toners are supplied from toner bottles and are stored inside of the developing apparatus 5. This developing roller 5*a* comprises a developing sleeve that coaxially rotates around a magnetic roller, which is the magnetic field generation means. The carrier in the developer rises up on the developing roller 5*a* based on magnetic force that the magnetic roller produces, is transported to the developing region facing the photosensitive member 1. Here, at the region opposing the photosensitive member 1 (called "developing region" hereinafter) the surface of the developing roller 5*a* moves in the same direction and at a greater linear velocity than the surface of the photosensitive member 1. Then, while rubbing the surface of the photosensitive member 1, the carrier that has risen up on the developing roller 5*a* supplies toner adhering to the surface of the carrier, and develops the surface of the photosensitive member 1. Developing bias from a power source not indicated in the diagram is applied to the developing roller 5*a* at this time, and thereby forms a developing electric field in the developing region.

An intermediate transfer belt 6*a* of a transfer apparatus 6 is tensioned between three support rollers 6*b*, 6*c*, and 6*d*, and is configured to move endlessly in the direction of the arrow in the diagram. The toners on the photosensitive members 1Y, 1C, 1M and 1K are transferred onto this intermediate transfer belt 6*a* in a mutually overlapping manner by an electrostatic transfer system. The electrostatic transfer system may also be configured using transfer charges, but here a configuration using a transfer roller 6*e* that produces little transfer dust is adopted. Concretely, primary transfer rollers 6*e*Y, 6*e*C, 6*e*M, and 6*e*K, which are the transfer apparatuses 6, are arranged on the back surface of the intermediate transfer belt 6*a* in positions to make contact with the photosensitive members 1Y, 1C, 1M, and 1K respectively. Here, the primary transfer regions are formed by the parts of the intermediate transfer belt 6*a* that are pressurized by the primary transfer roller 6*e* and the photosensitive member 1. Then, when the toner images on the photosensitive members 1Y, 1C, 1M and 1K are transferred onto the intermediate transfer belt 6*a*, positive polarity bias is applied to the primary transfer roller 6*e* . Transfer electric fields are formed in the regions that make the primary transfer (called "transfer regions" hereinafter), and the toner images on the photosensitive member 1Y, 1C, 1M and 1K electrostatically adhere to and are transferred onto the intermediate transfer belt 6*a*.

Provided on the periphery of the intermediate transfer belt 6*a* is a belt cleaning apparatus 6*f* for eliminating residual toner on the surface thereof. This belt cleaning apparatus 6*f* is configured such that the unnecessary toner adhering to the surface of the intermediate transfer belt 6*a* is recovered by fur brush and cleaning blade. The unnecessary toner that has been recovered is transported from within the belt cleaning apparatus 6*f* to a discharged toner tank, not indicated in the diagram, by a transport means, not indicated in the diagram.

Moreover, a secondary transfer roller 6*g* is arranged to touch the part of the intermediate transfer belt 6*a* that is tensioned by the support roller 6*d* . A secondary transfer region is formed between this intermediate transfer belt 6*a* and secondary transfer roller 6*g*, and transfer paper, which is the recording member, is sent into this part at a specified timing. This transfer paper is housed in a paper supply cassette 9 below the exposure apparatus 4 in the diagram, and is transported to the secondary transfer region by a pick up roller 10 and a resist roller pair 11, etc. Then, all of the toner images laminated on the intermediate transfer belt 6*a* are transferred together onto the transfer paper at the secondary transfer region. A positive polarity bias is applied to the secondary transfer roller 6*g* at the time of this secondary transfer, and the toner image on the intermediate transfer belt 6*a* is transferred onto the transfer paper by the transfer electric field formed thereby.

The lubricant coating apparatus 21 mainly comprises a lubricant molded body 21*b* housed in a fixed case, a brush-shaped roller 21*a* that contacts the lubricant molded body 21*b*, scrapes off the lubricant, and coats the lubricant on the photosensitive member 1, and a pressure spring 21*c* that pushes the lubricant molded body 21*b* onto the brush-shaped roller 21*a*. The lubricant molded body 21*b* is formed in the shape of a rectangular solid, and the brush-shaped roller 21*a* has a shape extended in the axial direction of the photosensitive member 1. The lubricant molded body 21*b* is energized by the pressure spring 21*c* in relation to the brush-shaped roller 21*a* such that nearly all of the lubricant can be used. The lubricant molded body 21*b* is a consumable part and the thickness thereof decreases over time, but always makes contact with the brush-shaped roller 21*a* because of the pressurization by the pressure spring 21*c*.

Fatty acid metal salts, silicone oil, and fluorine group resins, etc. may be cited as lubricants, and these may be used singly or in combinations of two or more kinds. Specifically, fatty acid metal salts are preferable. Among fatty acid metal salts, straight-chain hydrocarbons, for example, myristic acid, palmitic acid, stearic acid, and oleic acid, etc. are preferable as fatty acids; and stearic acid is more preferable. Lithium, magnesium, calcium, strontium, zinc, cadmium, aluminum, cerium, titanium, and iron, etc. may be cited as metals. Among these, zinc stearate, magnesium stearate, aluminum stearate, and iron stearate, etc. are preferable, and zinc stearate is particularly preferable.

Moreover, the cleaning apparatus 7 comprises a cleaning blade 7*a*, a support member 7*b*, a toner recovery coil 7*c*, and a blade pressure spring 7*d*. The cleaning blade 7*a* removes the toner remaining on the photosensitive member 1 after transfer. The cleaning blade is affixed to the support member 7*b*, and is arranged in the cleaning apparatus, but the support member 7*b* is not particularly limited and metal, plastic, ceramic etc. may be used.

The cleaning blade 7*a* is an elastic body with a low friction coefficient, and among urethane resins, silicone resins, and fluorinated resins, urethane elastomers, silicone elastomers, and fluorine elastomers may be cited. Thermoset urethane resin is preferable as the cleaning blade 7*a*, and urethane elastomers is particularly preferable from the standpoint of abrasion resistance, ozone resistance, and contamination resistance. Rubber is also included in elastomers. The hardness (JIS-A) of the cleaning blade 7*a* is preferable in the range of 65 to 85. Moreover, the thickness of the cleaning blade 7*a* is 0.8 to 3.0 mm, and the amount protruding out is preferably in the range of 3 to 15 mm. Further, other conditions including contact pressure, contact angle, and amount of impression, etc. may be suitably set.

The charge apparatus 3 comprises a charge roller 3*a* as the charge member arranged facing the photosensitive member 1, and a charge cleaning member 3*b* arranged so that the charge roller 3*a* makes contact with the surface opposite the surface opposing the photosensitive member 1. The surfaces of the charge roller 3*a* and the photosensitive member 1 may be either in a near contact system arranged having a tiny gap in relation to the photosensitive member 1 or in a system that makes contact with the photosensitive member 1.

The charge roller 3*a* is connected to a power source, and the specified voltage is applied. That voltage is a voltage that superimposes AC voltage onto DC voltage. By applying AC voltage, the surface of the photosensitive member 1 can be more evenly charged.

The frequency of the AC voltage is determined based on the photosensitive member linear velocity that comes from the print velocity. The frequency must be set to seven times or more the linear velocity of the photosensitive member. If less than seven times, then AC frequency cycle jitters may be observed as halftone images in the uniform intermediate potential image.

The image forming apparatus of the present embodiment has multiple photosensitive member linear velocities, and the frequency of the AC bias is fixed at the frequency necessary for the highest photosensitive member linear velocity. In this case, no jitters are produced even during low linear velocity, but filming is produced on the surface of the photosensitive member by excess discharge during low linear velocity.

Thus, the image forming apparatus of the present embodiment is configured such that a filming removal mode to remove filming is set up in the control unit, not indicated in the diagram, and the filming removal mode is selected corresponding to the linear velocity of the photosensitive member.

After a specified number of pages have passed through, the aforementioned filming removal mode turns the power of the charge apparatus to OFF and sets the developing bias of the developing apparatus 5 to −50 V, and after toner has been applied by rotating the photosensitive member 1 around one time and forming a halftone image on the surface of the photosensitive member 1, the power source of the charge apparatus is turned OFF, the developing bias of the developing apparatus 5 is turned OFF, the clutch of the developing roller 5*a* is turned OFF, and the photosensitive member 1 is rotated 30 times. During this rotation, the photosensitive member 1 is made to have low friction and to not allow adhesion of foreign matter by using the lubricant coating apparatus 21 to coat the surface of the photosensitive member with lubricant. Moreover, the applied toner adheres to the brush of the lubricant coating apparatus 21, and the lubricant is reliably scraped off; in addition, the contact part between the photosensitive member and the cleaning blade, and the developing nip part between the photosensitive member 1 and the development roller that has stopped rotating are closed off, and the filming adhering to the surface of the photosensitive member is rubbed off.

Figure 3:
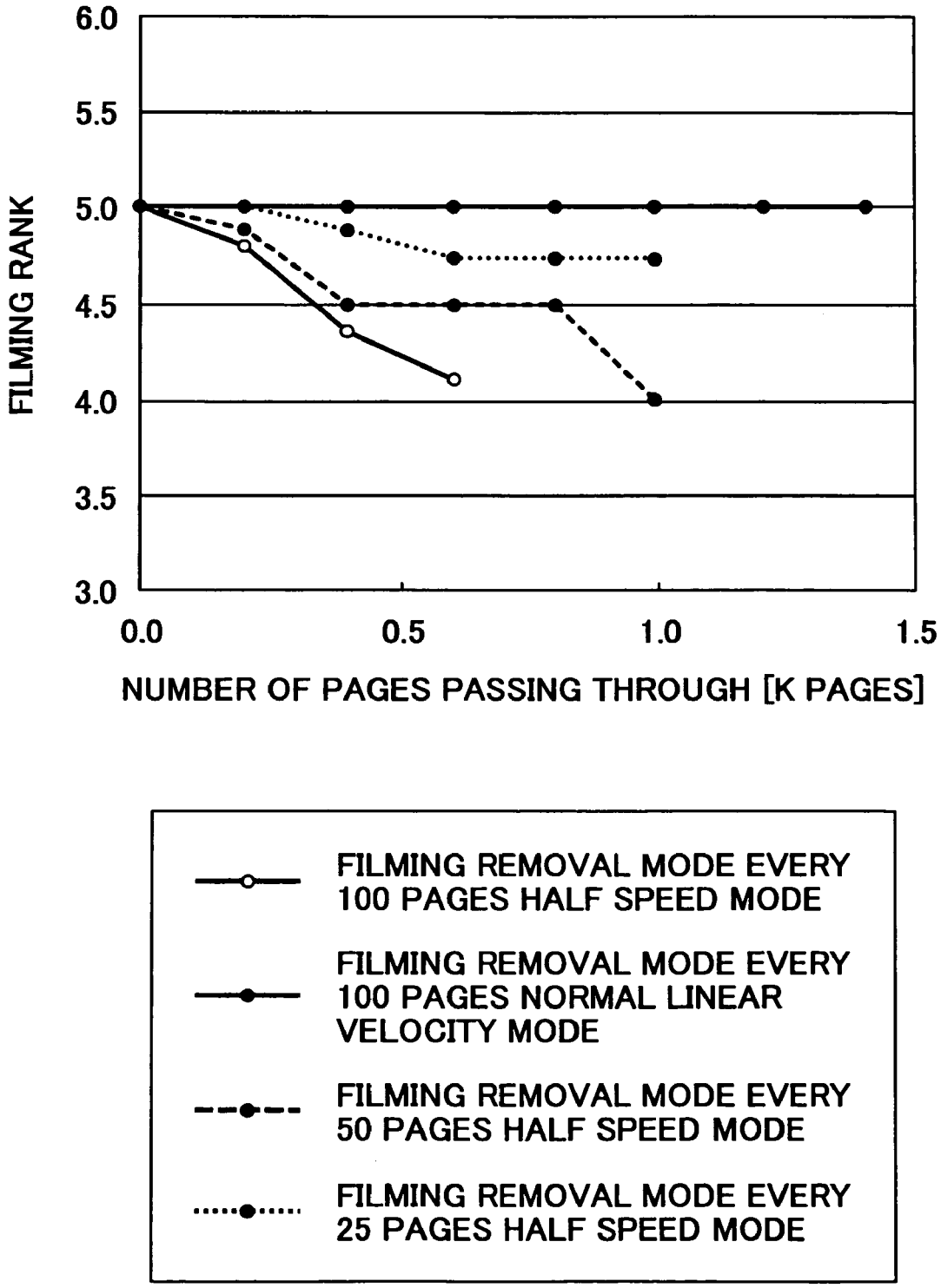
FIG. 3 is a diagram indicating the number of pages passing through and a ranking of the filming produced at every linear velocity.

Indicated in FIG. 3 is a diagram indicating the number of pages passing through and a ranking of the filming produced at each linear velocity. If 4.5 to 5.0, the filming rank is in the permissible range. The normal linear velocity mode prints an image quality of 600 dots per inch (DPI); the half velocity mode prints an image quality of 1200 DPI, and the linear velocity of the photosensitive member is one half that of the normal linear velocity. As indicated in FIG. 3, the filming rank is in the range of 4.5 to 5.0 and filming is effectively prevented by conducting the filming removal mode every 100 pages passing through in the normal linear velocity mode, and every 25 pages passing through in the half velocity mode.

Figure 4:
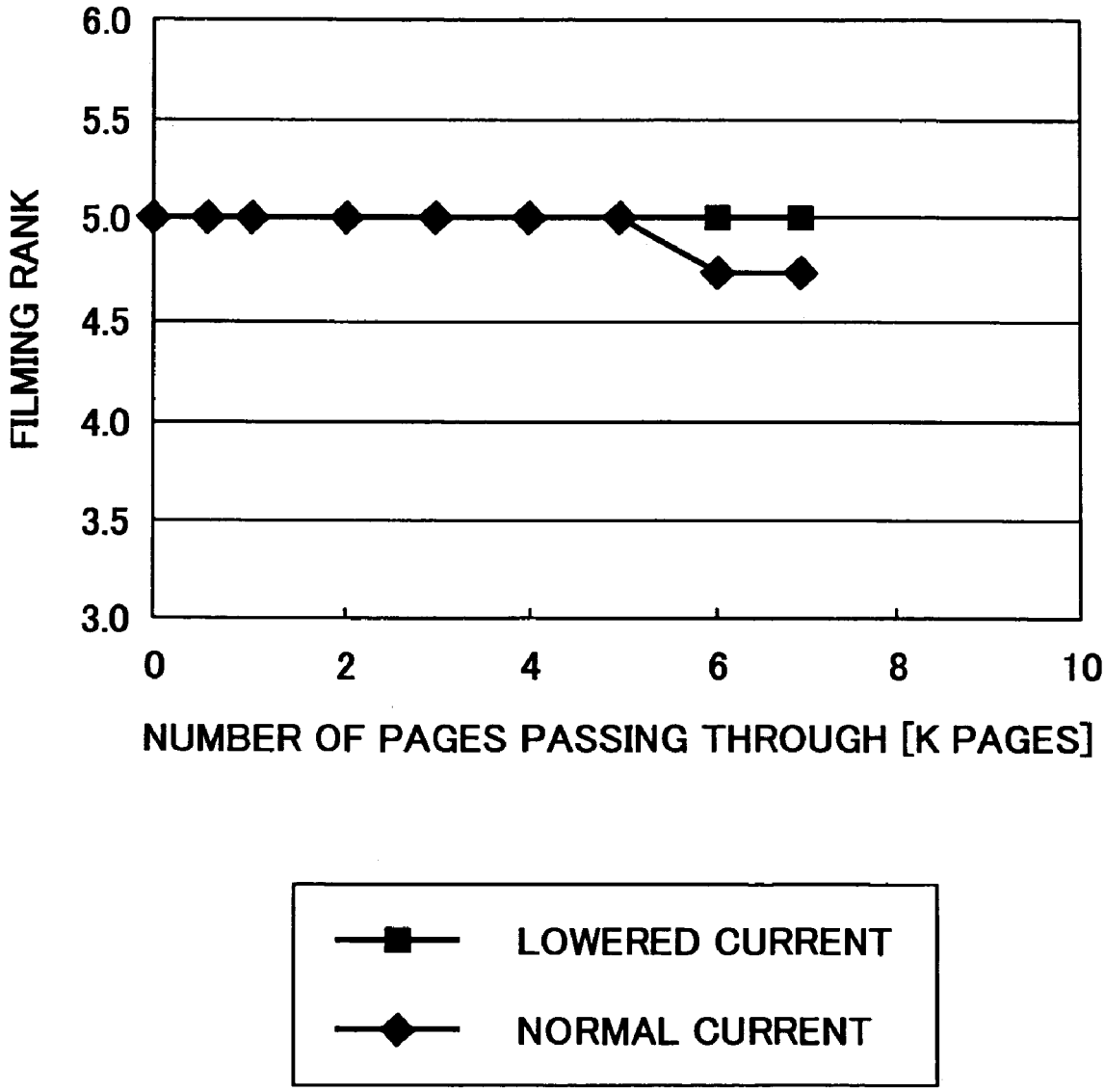

FIG. 4 is a diagram indicating a ranking of the filming produced at every cumulative number of pages passing through. With the AC charge current fixed, the filming rank dropped from 5.0 to 4.7 after about 5,000 pages. Even though the filming removal mode was conducted as described above, it appears that, filming substance accumulated a little at a time. Then, just by lowering the specified amount of AC charge current after 5,000 copies, the filming rank was maintained at 5.0, and did not drop. If the AC charge current is dropped too much, the original objective of making a uniform charge could not be maintained. In this experiment, the inventors limited the drop to about 100 μA.

According to the above, even if the multiple photosensitive member linear velocities are provided and the AC frequency of the charge apparatus is fixed, it is possible to prevent generation of filming using the simplest possible configuration without providing a filming removal apparatus. Moreover, because is it not necessary to provide a filming removal apparatus it is possible to prevent the generation of filming at low cost.

Further, it is possible to make a process cartridge formed to freely attach to and detach from the main body of the image forming apparatus by supporting the aforementioned photosensitive member 1 in a single unit with another apparatus optionally selected from among the charge apparatus 3, the developing apparatus 5, the cleaning apparatus 7, or the lubricant coating apparatus 21. The cleaning performance on the surface of the photosensitive member 1 can be maintained over a long time by using this process cartridge, and thus a process cartridge can be made that does not produce degradation of image quality.

Moreover, making a process cartridge is advantageous in terms of maintenance, and it is possible to shorten the service time because, if damage occurs to the photosensitive member 1, the charge apparatus 3, the developing apparatus 5, the cleaning apparatus 7, or the lubricant coating apparatus 21, recovery to the original state can be rapidly accomplished simply by replacing the cartridge. In addition, giving the photosensitive member 1 favorable cleaning characteristics greatly contributes to lengthening the operating life of the process cartridge.

The image forming apparatus of the present embodiment is particularly effective when using small particle size, spherical toner as described below.

The toner used in developing apparatus 5 has a volume average particle diameter of 3 to 8 μm, and preferably the ratio (Dv/Dn) of the volume average particle diameter (Dv) and number average particle diameter (Dn) is in the range of 1.00 to 1.40.

Using small particle size toner can make the toner adhere compactly to the latent image. Nonetheless, if the volume average particle diameter is smaller than the range of the present invention, then, when using a two-component developer, the toner fuses to the surface of the magnetic carrier based on agitation over a long time in the developing apparatus 5, and the charge capacity of the magnetic carrier is lowered; and when using a one-component developer, toner filming onto the developing roller 5*a*, and toner fusing to parts such as the blade for making a thin layer of toner are prone to occur. If the contrary occurs, and the volume average particle diameter is larger than the range of the present invention, then it is difficult to obtain high resolution, high quality images, and large fluctuations of toner particle size may often occur when balancing the toner in the developer.

In addition, by narrowing the particle size distribution, the distribution of toner charge can be made uniform; high definition images with little fogging can be obtained; and a high transfer percentage can be achieved. Nonetheless, a Dv/Dn exceeding 1.40 is unsatisfactory because the charge distribution is broadened and the power of resolution is also lowered.

Further, the average particle diameter and particle size distribution of the toner can be measured using a Coulter counter TA-11 or Coulter multisizer 11 (both manufactured by Coulter Inc.). In the present invention, measurements were taken by connecting an interface (manufactured by Nikka Giken), which outputs the number distribution and volume distribution obtained using a Coulter counter TA-11, to a personal computer (PC9801: manufactured by NEC).

By making smaller particles, the percentage occupied in the toner by wax for improving the release characteristics and of inorganic micro-particles for improving the fluidity, which are internally or externally added to the toner, is higher in the toner described above than in conventional toners. Then, this becomes a factor in the adhering substances that these additives generate on the photosensitive member 1. Thus, according to the present embodiment, a uniform thin film of lubricant is formed across the entire surface region of the photosensitive member 1, and can reduce the adhesive force of these adhering substances to the surface of the photosensitive member 1. In addition, cleaning can be favorably conducted by reducing the force of friction working between the surface of the photosensitive member 1 and the cleaning blade 7*a* of the cleaning apparatus 7.

Moreover, the toner used in the developing apparatus 5 preferably has a shape factor SF-1 in the range of 100 to 180, and a shape factor SF-2 in the range of 100 to 180.

Figure 5A:
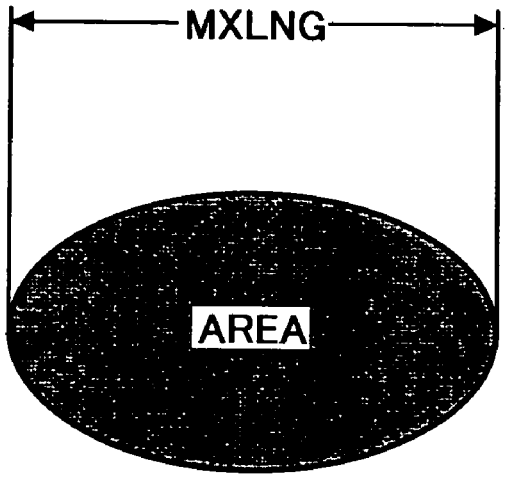
FIGS. 5A and 5B are diagrams representing patterns of toner shape in order to explain shape factor SF-1 and shape factor SF-2.
Figure 5B:
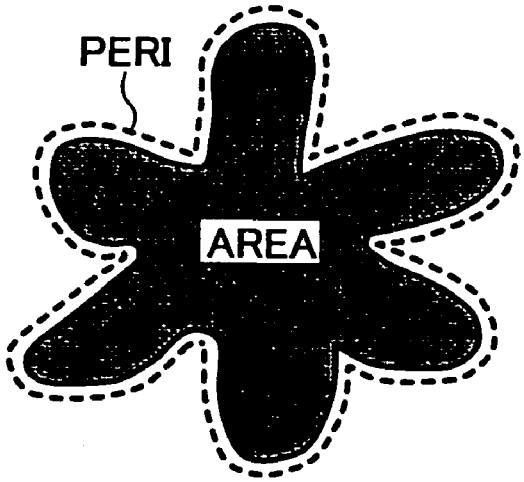

FIGS. 5A and 5B are indicate patterns of toner shape in order to explain shape factor SF-1 and shape factor SF-2. Shape factor SF-1 indicates the percentage of roundness of the toner shape, and is represented by equation (1) below. This is the value of the square of the maximum length (MXLNG) of the shape in which toner can be projected on a two-dimensional surface divided by the area of the diagram and multiplied by 100π/4.

$$SF\text{-}1=\{(MXLNG)^2/\text{area}\}\times(100\pi/4) \quad \text{Eq. (1)}$$

The toner shape when the SF-1 value is 100 is a sphere, and the SF-1 value becomes larger the more the shape becomes irregular.

Shape factor SF-2 indicates the percentage of contours of the toner shape, and is represented by equation (2) below. This is the value of the square of the perimeter (PERI) of the shape in which toner can be projected on a two-dimensional surface divided by the area of the diagram and multiplied by 100π/4.

$$SF\text{-}2=\{(PERI)^2/\text{area}\}\times(100\pi/4) \quad \text{Eq. (2)}$$

The toner shape when the SF-2 value is 100 has no contours, and the SF-2 value increases the more notable the toner shape contours become.

Because the contact between toner and toner or toner and photosensitive member 1 becomes closer to point contact as the toner shape approaches that of a sphere, the adhering force between toner particles become weaker, and consequently, the fluidity becomes higher; moreover, the adhering force between the toner and photosensitive member 1 becomes weaker, and the transfer percentage becomes higher. Meanwhile, because spherical toner is prone to enter the gap between the cleaning blade 61 and the photosensitive member 1, to a certain degree it is better to have a higher toner shape factor SF-1 or SF-2. Moreover, As the SF-1 and SF-2 become larger, the toner becomes scattered on the image, and the image quality drops. For this reason, the SF-1 and SF-2 preferably do not exceed 180.

Specifically, the shape coefficient is measured by photographing the toner with a scanning electron microscope (S-800: manufactured by Hitachi Manufacturing Laboratories), introducing this into an image analyzer (LUSEX3: manufactured by Nireco), and conducting analysis and calculations.

The toner suitably used in the image forming apparatus of the present embodiment is obtained, for example, by allowing a toner material solution, in which at least polyester prepolymer having a functional base including a nitrogen atom, polyester, colorant, and releasing agent are dispersed in an organic solvent, to undergo a bridging and/or elongation reaction in a hydrogen-containing solvent. The toner will be explained below by citing examples of the configuring materials and the production method.

(Modified Polyester)

Toner of the present embodiment includes modified polyester (i) as the binder resin. Modified polyester (i) indicates a state in which a bonding group other than an ester bond is present in the polyester resin, or a different resin component configured in the polyester resin is bonded by a covalent bond or ion bond, etc. Concretely, a substance is indicated in which a polyester terminal is modified by introducing a functional group such as an isocyanate group that reacts with a carboxylic acid group or hydroxide group to a polyester terminal, and then reacting with an active hydrogen-containing compound.

Urea modified polyesters obtained by allowing isocyanate group-containing polyester prepolymer (A) and amines (B) to react may be cited as examples of modified polyester (i). For example, a polyester that is a polycondensation product of a polyol (PO) and a polycarboxylic acid (PC) and that contains active hydrogen-containing group, and is then allowed to react with a polyisocyanate (PIC) may be cited as an isocyanate group-containing polyester prepolymer (A). The active hydrogen-containing group of the above polyester includes a hydroxyl group (an alcoholic hydroxyl group and phenolic hydroxyl group), amino group, carboxylic group, mercapto group, etc., among which an alcoholic hydroxyl group is preferred.

Urea modified polyester is produced in the following way.

Polyols (PO) include diol (DIO) and polyols having three or more hydroxyl groups (TO), and it is preferable to use (DIO) alone, or a mixture of (DIO) and a small amount of (TO). Diols (DIO) include alkylene glycols (ethylene glycol, 1,2-propylene glycol, 1,3-propylene glycol, 1,4-butane diol, 1,6-hexane diol, etc.); alkylene ether glycols (diethylene glycol, triethylene glycol, dipropylene glycol, polyethylene glycol, polypropylene glycol polytetramethylene ether glycol, etc.); alicyclic diols (1,4-cyclohexane dimethanol, hydrogenated bisphenol A, etc.); bisphenols (bisphenol A, bisphenol F, bisphenol S, etc.); adducts of the aforementioned alicyclic diols with alkylene oxides (ethylene oxide, propylene oxide, butylene oxide, etc.); adducts of the aforementioned bisphenols with alkylene oxides (ethylene oxide, propylene oxide, butylene oxide, etc.); etc. Among these, alkylene glycols having 2 to 12 carbon atoms and adducts of bisphenols with alkylene oxides are preferred, and particularly preferred are adducts of bisphenols with alkylene oxides and a mixture thereof with alkylene glycols having 2 to 12 carbon atoms. Polyols having three or more hydroxyl groups (TO) include polyhydric aliphatic alcohols having 3 to 8 or more hydroxyl groups (glycerin, trimethylolethane, trimethylolpropane, pentaerythritol, sorbitol, etc.); phenols having 3 or more hydroxyl groups (trisphenol PA, phenol novolac, cresol novolac, etc.); adducts of the aforementioned polyhydric phenols having 3 or more hydroxyl groups with alkylene oxides; etc.

Polycarboxylic acids (PC) include dicarboxylic acids (DIC), polycarboxylic acids having three or more hydroxyl groups (TC), etc., and it is preferable to use (DIC) alone, or a mixture of (DIC) and a small amount of (TC). Dicarboxylic acids (DIC) include alkylene dicarboxylic acids (succinic acid, adipic acid, sebacic acid, etc.); alkenylene dicarboxylic acids (maleic acid, fumaric acid, etc.); aromatic dicarboxylic acids (phthalic acid, isophthalic acid, terephthalic acid, naphthalene dicarboxylic acid, etc.); etc. Among these, alkenylene dicarboxylic acids having 4 to 20 carbon atoms and aromatic dicarboxylic acids having 8 to 20 carbon atoms are preferable. Polycarboxylic acids having three or more hydroxyl groups (TC) include aromatic polycarboxylic acids having 9 to 20 carbon atoms (trimellitic acid, pyromellitic acid, etc.) etc. It is of note that polycarboxylic acids (PC) may be replaced with an acid anhydride or a lower alkyl ester (methyl ester, ethyl ester, isopropyl ester, or the like) of the above-described carboxylic acids to be reacted with polyols (PO).

The ratio of a polyol (PO) to a polycarboxylic acid (PC), by the equivalent ratio of hydroxyl groups (OH) to carboxyl groups (COOH), which is [OH]/[COOH], is typically 2/1 to 1/1, preferably 1.5/1 to 1/1, more preferably 1.3/1 to 1.02/1.

Polyisocyanates (PIC) include aliphatic polyisocyanates (tetramethylene diisocyanate, hexamethylene diisocyanate, 2,6-diisocyanate methylcaproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); aromatic aliphatic diisocyanates $\alpha$, $\alpha$, $\alpha'$, $\alpha'$-tetramethylxylene diisocyanate etc.); isocyanates; above-mentioned polyisocyanates blocked with a phenol derivative, an oxime, caprolactum, or the like; and combinations of two or more of these.

The ratio of a polyisocyanate (PIC), by the equivalent ratio of isocyanate groups (NCO) to hydroxyl groups (OH) of the polyester, which is [NCO]/[OH], is typically 5/1 to 1/1, preferably 4/1 to 1.2/1, more preferably 2.5/1 to 1.5/1. When the ratio [NCO]/[OH] is more than 5, low-temperature fusibility is degraded. When the molar ratio of [NCO] is less than 1, the amount of urea in the modified polyester is low and thus adversely affect hot offset resistance.

The amount of polyisocyanate (PIC) component in an isocyanate group-containing polyester prepolymer (A) (containing at an end) is typically 0.5% to 40% by weight, preferably 1% to 30% by weight, more preferably 2% to 20% by weight. If the amount is less than 0.5% by weight, hot offset resistance is lowered and it is disadvantageous with regards to satisfying heat-resistance during storage and low-temperature fusibility at the same time. If the amount is more than 40% by weight, low-temperature fusibility is reduced.

The number of isocyanate groups contained in each molecule of isocyanate group-containing polyester prepolymer (A) is typically one or more, preferably 1.5 to 3 on average, more preferably 1.8 to 2.5 on average. If it is less than one per molecule, the molecular weight of the urea modified polyester is reduced, and hot offset resistance is degraded.

Next, polyester prepolymers (A) and reaction amines (B) include diamines (B1), polyamines having 3 or more amino groups (B2), amino alcohols (B3), amino mercaptans (B4), amino acids (B5), derivatives of B1 to B5 in which the amino groups are blocked (B6), etc.

Diamines (B1) include aromatic diamines (phenylene diamine, diethyltoluene diamine, 4,41-diaminodiphenylmethane, etc.); alicyclic diamines (4,4-diamino-3,3'-dimethyldicyclohexylmethane, diaminocyclohexane, isophoronediamine, etc.); aliphatic diamines (ethylenediamine, tetramethylenediamine, hexamethylenediamine, etc.); etc. Polyamines having three or more amino groups (B2) include diethylenetriamine, triethylenetetramine, etc. Amino alcohols (B3) include ethanolamine, hydroxyethylaniline, etc. Amino mercaptans (B4) include aminoethyl mercaptan, aminopropyl mercaptan, etc. Amino acids (B5) include amino propionic acid, aminocaproic acid, etc. The aforementioned derivatives of B1 to B5 in which the amino groups are blocked (B6) include ketimine compounds that are obtained from amines of B1 to B5 and ketones (acetone, methylethylketone, methylisobutylketone, etc.), and oxazolidine compounds, etc. Among these amines (B), B1 and a mixture of B1 and a small amount of B2 are preferable.

The ratio of amines (B) by the equivalent ratio of isocyanate groups [NCO] in the isocyanate group-containing polyester prepolymer (A) to amino groups [NHx] in the amine (B), which is [NCO]/[NHx], is typically 1/2 to 2/1, preferably 1.5/1 to 1/1.5, more preferably 1.2/1 to 1/1.2. If the ratio [NCO]/[NHx] is more than 2 or less than 1/2, the molecular weight of the urea modified polyester will be low and its hot offset resistance will be degraded.

Moreover, urethane bonds may be contained together with urea bonds in the urea modified polyester. The mol ratio of the urea bond content to the urethane bond content is normally 100/0 to 10/90, preferably 80/20 to 20/80, and most preferably, 60/40 to 30/70. If the urea bond mol ratio is less than 10%, then the hot offset resistance will be degraded.

The modified polyester (i) used in the present embodiment is produced by a one shot, prepolymer method. The weight average molecular weight of the modified polyester (i) is typically 10,000 or more, preferably from 20,000 to 10,000,000, and most preferably from 30,000 to 1,000,000. The peak molecular weight at this time is preferably from 1,000 to 10,000, and if less than 1,000, then the elongation reaction becomes difficult, the toner has little elasticity, and the result is degradation of the hot offset resistance. Moreover, if exceeding 10,000, the decrease in fusibility, particularization and crushing become manufacturing problems. The number average particle weight of the modified polyester (i) is not particularly limited if the unmodified polyester (ii) described later is used, and may be a number average molecular weight easily obtained in order to make the aforementioned weight average molecular weight. If used singly, the number average molecular weight of (i) is normally 20,000 or less, preferably from 1,000 to 10,000, and most preferably from 2,000 to 8,000. If exceeding 20,000, the low temperature fusibility and luster when used in full color apparatuses deteriorate.

It is possible to adjust the molecular weight of the urea modified polyester obtained in the elongation or crosslinking reaction between the polyester prepolymer (A) and the amine (B) in order to obtain the modified polyester (i) by using a reaction inhibitor as necessary. Monoamine (diethylamine, dibutylamine, butylamine, laurylamine, etc.) blocked monoamines (ketimine compounds), etc. may be cited as reaction inhibitors.

Further, the molecular weights of the polymers synthesized can be measured using gel permeation chromatography (GPC) using THF as the solvent.

(Unmodified Polyester)

For the present embodiment, the aforementioned modified polyester (i) can be used alone, but an important use is to use an unmodified polyester (ii) included as a binder resin component in addition to (i). Use in conjunction with (ii) is preferable to independent use as low-temperature fusibility and the glossy quality when used in a full-color device are improved. Examples of (ii) include the same polyester components of (i) above, which are condensation polymerization products of polyols (PO) and polycarboxylic acids (PC), and preferred examples are also the same as those of (i). In addition to an unmodified polyester, (ii) can also be a polyester modified by a chemical bond other than a urea bond, for example, a urethane bond. It is preferable from the standpoint of low-temperature fusibility and hot offset resistance that (i) and (ii) form a mixture that is compatible at least in a portion thereof. Therefore, it is preferred that the polyester component of (i) and (ii) have similar compositions. When including (ii) in the mixture, the weight ratio of (i) to (ii) is typically 5/95 to 80/20, preferably 5/95 to 30/70, more preferably 5/95 to 25/75, and most preferably 7/93 to 20/80. When the weight ratio of (i) is less than 5%, hot offset resistance is degraded, and it is disadvantageous with regards to simultaneously satisfying heat-resistance during storage and low-temperature fusibility.

The peak molecular weight of (ii) is typically from 1,000 to 10,000, preferably from 2,000 to 8,000, more preferably from 2,000 to 5,000. When it is lower than 1,000, heat-resistance during storage is degraded, and when it is higher than 10,000, low-temperature fusibility is degraded. The hydroxyl value of (ii) is preferably five or more, more preferably 10 to 120, and most preferably 20 to 80. When less than five, it is disadvantageous with regards to simultaneously satisfying heat-resistance during storage and low-temperature fusibility. The acid value of (ii) is typically one to five, preferably two to four. Using high acid wax makes it easy to match a toner using a two-component developer because a low acid binder is linked to charge characteristics and high volume resistance.

The glass transition temperature (Tg) of the binder resins is typically from 35 to 700° C., preferably 55 to 65° C. When lower than 35° C., the heat-resistance during storage of the toner is degraded, and when higher than 70° C., the low-temperature fusibility becomes insufficient. Because urea modified polyesters prone to stay on the surface of the toner base particles obtained, even if having a low glass transition temperature the toner of the present invention exhibits better storage characteristics than well-known polyester toners.

The glass transition temperature (Tg) can be measured by differential scanning calorimeter (DSC)

(Colorant)

For the colorant, any well-known dye or pigment can be used, for example, carbon black, nigrosine dye, iron black, naphthol yellow S, Hanza yellow (10G, 5G, G), cadmium yellow, yellow iron oxide, ocher, chrome yellow, titanium yellow, polyazo yellow, oil yellow, Hanza yellow (GR, A, RN, R), pigment yellow L, benzidine yellow (G, GR), permanent yellow (NCG), Balkan fast yellow (5G, R), tartrazine lake, quinoline yellow lake, anthracene yellow BGL, isoindolinone yellow, red iron oxide, minium, lead vermilion, cadmium red, cadmium mercury red, antimony vermilion, Permanent-Red 4R, Para Red, Fire Red, p-chloro-o-nitroaniline red, risol fast scarlet G, brilliant fast scarlet, Brilliant Carmine BS, permanent red (F2R, F4R, FRL, FRLL, F4RH), fast scarlet VD, Vulcan Fast Rubine B, brilliant scarlet G, Lithol Rubine GX, permanent-Red F5R, brilliant carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, rhodamine lake B, rhodamine lake Y, alizarin lake, Thioindigo Red B, Thioindigo Maroon, oil red, quinacridone red, pyrazolone red, polyazo red, chrome vermilion, benzidine orange, Perynone Orange, oil orange, cobalt blue, cerulean blue, alkali blue lake, peacock blue lake, Victoria blue lake, non-metallic phthalocyanine blue, phthalocyanine-blue, fast sky blue, Indanthrene Blue (RS, BC), indigo, ultramarine blue, Berlin blue, anthraquinone blue, fast violet B, methyl violet lake, cobalt purple, manganese purple, dioxane violet, anthraquinone violet, chrome green, zinc green, chrom oxide, viridian, emerald green, pigment green B, naphthol green B, green gold, acid green lake, malachite-green lake, phthalocyanine green, anthraquinone green, titanium oxide, zinc white, lithopone, and mixtures thereof may be used. The content of the colorant is typically 1 to 15% by weight, and is preferably 3 to 10% by weight, relative to the toner.

A colorant of the present invention can be combined with a resin and used as a master batch. Binder resins to manufacture a master batch or knead together with a master batch include, for example, polymers of styrene or substituted styrenes such as polystyrene, poly p-chlorostyrene, polyvinyl toluene, etc., or copolymers thereof with vinyl compound; polymethylmethacrylate, polybutylmethacrylate, polyvinyl chloride, polyvinyl acetate, polyethylene, polypropylene, polyester, epoxy resins, epoxy polyol resins, polyurethanes, polyamides, polyvinyl butyral, polyacrylic resins, rosin, modified rosin, terpene resin, aliphatic or alicyclic hydrocarbon resins, aromatic petroleum resins, chlorinated paraffin, paraffin wax, etc. These may be used either alone or in combination of two or more.

(Charge Control Agent)

Any well-known charge control agent may be used, for example, negrosine dyes, triphenylmethane dyes, chrome-containing metal complex dyes, molybdic acid chelate dyes, rhodamine dyes, alkoxy amines, quaternary ammonium salts (including fluorinated quaternary ammonium salts), alkyl amides, phosphorus and its compounds, tungsten and its compounds, fluorine activating agents, metal salicilates, metal salts of salicylic acid derivatives, etc. Specific examples are Bontron 03 as the negrosine dye, Bontron P-51 as the quaternary ammonium salt, Bontron S-34 as the alloy metal azo dye, oxynaphthoic acid metal complex E-82, the salicylic acid metal complex E-84, the phenolic condensate E-89 (manufactured by Orient Chemical Industries), the quaternary ammonium salt molybdenum complexes TP-302, TP-415 (manufactured by Hodogaya Chemical Industries), the quaternary ammonium salt Copy Charge PSY VP2038, the triphenylmethane derivative Copy Blue PR, the quaternary ammonium salts Copy Charge NEG VP2036 and Copy Charge NX VP434 (manufactured by Hoechst), LRA-901, LR-147 as the boron complex (manufactured by Japan Carlit Co., Ltd.), copper phthalocyanine, perylene, quinacridone, azo pigments, and other polymer compounds containing a functional groups such as sulfonic acid group, carboxyl group, quaternary ammonium salt, etc. Of these, substances that control the toner by negative polarity are particularly preferable.

The amount of the charge control agent is determined according to the type of the binder resin, the presence or absence of additives that are used if necessary, and the process for manufacturing the toner including the dispersion method, and therefore is not particularly limited. However, preferably the range of 0.1 to 10 parts by weight relative to 100 parts by weight of the binder resin, more preferably 0.2 to 5 parts by weight, may be used. If more than 10 parts by weight, the chargeability of the toner is excessively large, the effect of the main charge control agent is diminished, the electrostatic attraction with the developing roller increases, resulting in a degradation in flow characteristics of the developer and a decrease in image density.

(Releasing Agents)

Wax with a low melting point of 50 to 120° C. more effectively moves between the fusing roller and the surface of the toner as a releasing agent when dispersed in the finder resin, and is thereby effective against high temperature offset without coating the fusing roller with an oily releasing agent. The following may be cited as examples of this kind of wax component. Vegetable waxes such as carnauba wax, cotton wax, tree wax, and rice wax; animal wax such as beeswax and lanolin; mineral wax such as ozokerite and ceresin; and petroleum wax such as paraffin, microcrystalline, and petrolatum may be cited as waxes. In addition to these natural waxes, long-chained alkyl group synthetic hydrocarbon waxes such as Fischer Tropsch wax and polyethylene wax; and synthetic waxes such as esters, ketones, and ethers may be cited. Further, fatty acid amides such as 12-hydroxystearic acid amide, stearic acid amide, anhydrous phthalic acid amide, and chlorinated hydrocarbon; and crystalline polymers having a long-chained alkyl group, which are crystalline polymer resins of low molecular weight, and which are homopolymers or copolymers (for example, n-stearyl acrylate-ethyl methacrylate copolymer, etc.) of polyacrylates such as poly-n-stearyl methacrylate and poly-n-lauryl methacrylate, may be used.

A charge controller and releasing agent may be melted and kneader together with the master batch and the binder resin, and of course may also be added when dissolving and dispersing in the organic solvent.

(Auxiliary Additives)

Inorganic particulates can preferably be used as auxiliary additives that complement flow, development and charge characteristics of the toner particles. The primary diameter of the inorganic particulates is preferably $5\times10^{-3}$ to 2μ, more preferably $5\times10^{-3}$ to 0.5μ. Further, the specific surface area measured by the BET method is preferably 20 to 500 $m^2/g$. The ratio of these inorganic particulates is preferably 0.01 to 5% by weight of the toner, and more preferably 0.01 to 2.0% by weight.

Specific examples of inorganic particulates can include silica, alumina, titanium oxide, barium titanate, magnesium titanate, calcium titanate, strontium titanate, zinc oxide, tin oxide, silica sand, clay, mica, silicic pyroclastic rock, diatomite, chromium oxide, cerium oxide, red iron oxide, antimony trioxide, magnesium oxide, zirconium oxide, barium sulfate, barium carbonate, calcium carbonate, silicon carbide, silicon nitride, etc. Here, combination with hydrophobic silica microparticles and hydrophobic titanium oxide microparticles is preferable. Specifically, if agitating and mixing both microparticles having an average particle diameter of $5\times10^{-2}$ μm or less is performed, the electrostatic force and Van der Waals forces are dramatically improved, and satisfactory image quality free of flaring can thereby be obtained without releasing the fluidity promoters from the toner, and transfer residual toner can also be reduced, also by agitation and mix in the developing apparatus performed to obtain the desired charge level.

While titanium oxide microparticles have superior environmental stability and image density stability, these particles tend to degrade charge start up characteristics, and adding more titanium oxide microparticles is greater than silica microparticles will greatly affect this kind of adverse effect. However, if the amount of hydrophobic silica microparticles and hydrophobic titanium oxide microparticles added is in the range of 0.3 to 1.5 weight percent, there will be no great loss of charge start up characteristics, the desired charge start up characteristics will be obtained, that is, sable image quality can be obtained even when repeatedly making copies.

Next, the manufacturing method of the toner will be explained. Here, a preferable manufacturing method is indicated, but the method is not limited.

(Toner Manufacturing Method)

1) Toner material solution prepared in which colorant, unmodified polyester, isocyanate group-containing polyester prepolymer, and releasing agent are dispersed in an organic solvent.

From the standpoint of later ease of removal, it is preferable that the organic solvent be volatile with a boiling point below 100° C. Specifically, toluene, xylene, benzene, carbon tetrachloride, methylene chloride, 1,2-dichloroethane, 1,1,2-trichloroethane, trichloroethylene, chloroform, monochloro benzene, dichloroethylidene, methyl acetate, ethyl acetate, methyl ethyl ketone, methyl isobutyl ketone, etc. can be used singly or in combinations of two or more kinds. Specifically, aromatic solvents such as toluene and xylene, and halogenated hydrocarbons such as methylene chloride, 1,2-dichloroethane, chloroform, and carbon tetrachloride are preferable. The amount of organic solvent used is typically 0 to 300 weight parts to 100 weight parts of polyester prepolymer, preferably 0 to 100 weight parts, and most preferably 25 to 70 weight parts.

2) The toner material solution is emulsified in a water medium in the presence of a surfactant and resin microparticles.

The water medium may be water alone, or water including an organic solvent such as alcohol (methanol, isopropyl alcohol, ethylene glycol, etc.), dimethylformamide, tetrahydrofuran, cellusolves (methyl cellusolve, etc.), and lower ketones (acetone, methyl ethyl ketone, etc.).

The amount of water medium used to 100 weight parts of toner material solution is typically 50 to 2,000 weight parts, and preferably 100 to 1,000 weight parts. If less than 50 weight parts, the dispersion of toner material solution is poor, and toner particles of the specified particle size cannot be obtained. Exceeding 20,000 weight parts is uneconomical.

Moreover, dispersing agents such as surfactants and resin microparticles may be suitably added to improve dispersion in the water medium.

Examples of surfactants include anionic surfactants such as alkyl benzene sulfonates, α-olefin sulfonates, phosphoric acid esters, or the like; amine salts such as alkylamine salts, aminoalcohol fatty acid derivatives, polyamine fatty acid derivatives, imidazoline, or the like; quaternary ammonium salt cationic surfactants such as alkyltrimethyl ammonium salts, dialkyl dimethyl ammonium salts, alkyl dimethyl benzyl ammonium salts, pyridinium salts, alkyl isoquinolinium salts, benzetonium chloride, or the like; non-ionic surfactants such as fatty acid amide derivatives, polyvalent alcohol derivatives, or the like; amphoteric surfactants such as alanine, dodecyldi(aminoethyl)glycine, di(octylaminoethyl)glycine, N-alkyl-N,N-dimethylammoniumbetaine, etc.

By using a surfactant having a fluoroalkyl group, an effect can be obtained with an extremely small amount of the surfactant. Examples of anionic surfactants having a fluoroalkyl group which can be conveniently used are fluoroalkyl carboxylic acids having 2 to 10 carbon atoms and metal salts thereof, disodium perfluorooctane sulfonylglutamate, sodium 3-[ω-fluoroalkyl (C6 to C11)oxy]-1-alkyl (C3 to C4)sulfonate, sodium 3-[ω-fluoroalkanoyl (C6 to C8)-N-ethylamino]-1-propane sulfonate, fluoroalkyl (C11 to C20) carboxylic acids and metal salts thereof, perfluoroalkyl carboxylic acids (C7 to C13) and metal salts thereof, perfluoroalkyl (C4 to C12) sulfonates and metal salts thereof, perfluorooctanesulfonic acid diethanolamide, N-propyl-N-(2-hydroxyethyl) perfluorooctane sulfonamide, perfluoroalkyl (C6 to C10) sulfonamide propyltrimethylammonium salt, perfluoroalkyl (C6 to C10)-N-ethylsulfonyl glycine salt, monoperfluoroalkyl (C6 to C16) ethyl phosphoric acid ester, etc.

Examples of the commercial products are Surflon S-111, S-112, S-113 (manufactured by Asahi Glass Co., Ltd.), Fluorad FC-93, FC-95, FC-98, and FC-129 (manufactured by Sumitomo 3M, Co., Ltd.), Unidyne DS-101 and DS-102 (manufactured by Daikin Industries, Ltd.), Megaface F-110, F-120, F-113, F-191, F-812, and F-833 (manufactured by Dainippon Ink and Chemicals Incorporated), Ekutop EF-102, 103, 104, 105, 112, 123A, 123B, 306A, 501, 201, and 204 (manufactured by Tochem Products), FTERGENT F-100 and F-150 (manufactured by NEOS), etc.

Examples of cationic surfactants are primary, secondary or tertiary amines having a fluoroalkyl group, quaternary ammonium salts of fatty acids such as perfluoroalkyl (C6 to C10) sulfonamide propyltrimethylammonium salt, or the like; benzalkonium salts, benzetonium chloride, pyridinium chloride and imidazolinium salts, examples of commercial products being Surflon S-121 (manufactured by Asahi Glass Co., Ltd.), Fluorad FC-135 (manufactured by Sumitomo 3M, Co., Ltd.). Unidyne DS-202 (manufactured by Daikin Industries, Ltd.), Megaface F-150 and Megaface F-824 (manufactured by Dainippon Ink and Chemicals Incorporated), Ekutop EF-132 (manufactured by Tochem Products), FTERGENT F-300 (manufactured by NEOS), etc.

Resin microparticles are added in order to stabilize the toner base particles that are formed in the water medium. For this purpose, microparticles are added so that the cover percentage present on the surface of the toner base particles is preferably in the range of 10 to 90%. For example, product names for 1-μ and 3-μ polymethylmethacrlate micro particles, 0.5-μ and 2-μ polystyrene microparticles, and 1-μ poly(styrene-acrylonitryl) microparticles include PB-200H (manufactured by Hanao), SGP (manufactured by Soken), technopolymer SB (manufactured by Sekisui Plastics), SGP-3G (manufactured by Soken), and Micropar (manufactured by Sekisui Fine Chemicals).

Inorganic compound dispersing agents such as tricalcium phosphate, calcium carbonate, titanium oxide, colloidal silica, hydroxyapatite, or the like can also be used.

As the dispersion agent, the aforementioned organic resin particles may be used jointly with an inorganic compound dispersion agent, and the dispersion droplets may also be stabilized by a high polymer protecting colloid. Examples are acids such as acrylic acid, methacrylic acid, α-cyanoacrylic acid, α-cyanomethacrylic acid, itaconic acid, crotonic acid, fumaric acid, maleic acid, maleic anhydride, or the like; (meth) acrylic monomers which contain hydroxyl groups such as β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl acrylic acid, 3-chloro-2-hydroxypropyl methacrylic acid, diethylene glycol monoacrylic acid ester, diethylene glycol monomethacrylic acid ester, glycerine monoacrylic acid ester, glycerine monomethacrylic acid ester, N-methylolacrylamide, N-methylolmethacrylamide, or the like; vinyl alcohol or ether of vinyl alcohol such as vinyl methyl ether, vinyl ethyl ether and vinyl propyl ether, etc., esters of compounds containing a carboxylic group with vinyl alcohol such as vinyl acetate, vinyl propionate and vinyl butyrate, etc., acrylamide, methacrylamide, diacetone acrylamide, methylol compounds thereof, or the like; acid chlorides such as acrylic acid chloride and methacrylic acid chloride, homopolymers and copolymers containing a nitrogen compound or heterocyclic ring such as vinyl pyridine, vinyl pyrolidone, vinyl imidazole, ethyleneimine, or the like; polyoxyethylene compounds such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester, or the like; celluloses such as methyl cellulose, hydoxyethyl cellulose, hydroxypropyl cellulose, or the like; etc.

There is no particular limitation on the dispersion method which may employ any dispersion apparatus known in the art such as low speed shear, high speed shear, friction, high-pressure jet, ultrasound, or the like. To obtain dispersed particles having a diameter of 2 to 20 μm, the high speed shear is preferred. When a high speed shear dispersion apparatus is used, there is no particular limitation on the rotation speed, but it is typically 1,000 to 30,000 rpm, and is preferably 5,000 to 20,000 rpm. There is no particular limitation on the dispersion time, but in the case of a batch process, this is typically 0.1 to 5 minutes. The temperature at which a dispersion is prepared is typically 0 to 150° C. (under pressure), preferably 40 to 98° C.

3) At the same time as the emulsifying solution is prepared, amines (B) are added, and reacted with the isocyanate base-containing polyester prepolymer (A).

This reaction occurs in conjunction with molecular chain elongation and/or crosslinking. The reaction time may be selected according to the reactivity of the combination of the isocyanate group in the polyester prepolymer (A) and the amine (B), and it is typically 10 minutes to 40 hours, and is preferably 2 to 24 hours. The reaction temperature is typically 0 to 150° C., and is preferably 40 to 98° C. A catalyst known in the art may also be used if required. Specific examples are dibutyl tin laurate, dioctyl tin laurate, etc.

4) After the reaction is complete, toner base particles are obtained by removing the organic solvent from the emulsified dispersion (reaction product), rinsing, and drying.

In order to remove the organic solvent, the temperature of the entire system is gradually raised while conducting laminar agitation, and after strongly agitating in a fixed temperature region, spindle-shaped toner base particles can be produced by removing the solvent. In addition, if using a dispersion stabilizer soluble in acid and alkali such as calcium phosphate salt, after dissolving the calcium phosphate salt using an acid such as hydrochloric acid, the calcium phosphate salt may be removed from the toner base particles by a method such as rinsing with water. Removal is even possible by other procedures such as decomposition using enzymes.

5) A charge control agent is implanted in the toner base particles obtained as above, and then toner is obtained by externally adding inorganic microparticles such as silica microparticles and titanium oxide microparticles.

The implantation of charge control agent and the external addition of inorganic microparticles are conducted by well-known methods such as using a mixer, etc.

A toner with a small particle size and sharp particle size distribution can be easily obtained thereby. Further, by strongly agitating in the organic solvent removal process, the shape can be controlled from that of a sphere to a rugby ball, and the surface morphology can also be controlled from smooth to wrinkled.

The shape of the toner related to the present embodiment is quasi-spherical, and can be represented by the following shape stipulations.

Figure 6A:
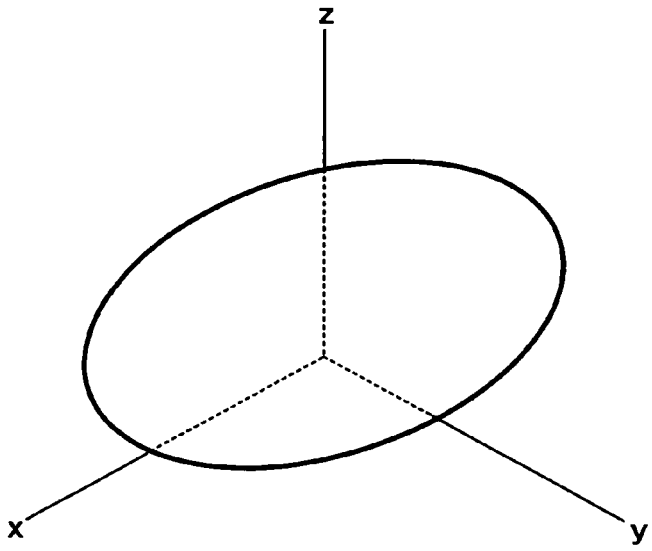
FIGS. 6A to 6C are diagrams indicating patterns of toner shape related to the present invention.
Figure 6B:
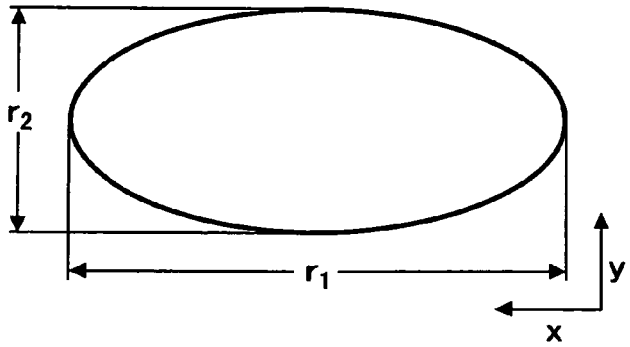
Figure 6C:
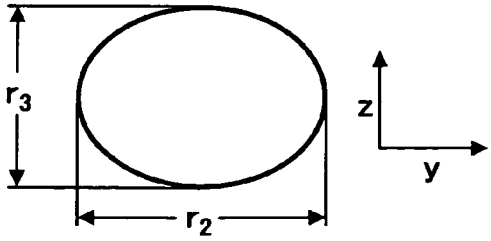

FIGS. 6A to 6C are diagrams indicating patterns of toner shape related to the present invention. In FIGS. 6A to 6C, when stipulating toner with a quasi-spherical shape by major axis r1, minor axis r2, and width r3 (here, let r1>r2>r3), the toner of the present embodiment preferably has a ratio between the major axis and minor axis (r2/r1) (refer to FIG. 6B) in the range of 0.5 to 1.0, and a ratio between the width and minor axis (r3/r2) (refer to FIG. 6C) in the range of 0.7 to 1.0. If the ratio between the major axis and minor axis (r2/r1) is less than 0.5, the dot reproducibility and transfer efficiency is poor because it is too far from a spherical shape, and high quality images cannot be obtained. Moreover, if the ratio between the width and minor axis (r3/r2) is less than 0.7, the shape approaches an ellipse, and the high transfer percentage of a spherical toner cannot be obtained. Specifically, if the ratio between the width and minor axis (r3/r2) is 1.0, then the particle will be come a rotating body with the major axis as the axis of rotation, and the toner fluidity can be improved.

Further, r1, r2, and r3 can be observed and measured by photographing with a scanning electron microscope (SEM) while varying the angle of the visual field.

The toner produced above can be used as a one-component magnetic toner without utilizing a magnetic carrier, or as a non-magnetic toner.

Moreover, if used in a two-component developer, the toner is best mixed with a magnetic carrier, and the magnetic carrier is a ferrite comprising a bivalent metal such as iron, magnetite, Mn, Zn, or Cu. A volume average particle diameter of 20 to 100 μm is preferable. If the average particle diameter is less than 20 μm, adhesion of the carrier to the photosensitive member 1 is prone to occur during development; and if 100 μm is exceeded, then the toner mixing characteristics drop, and toner with insufficient charge is produced and unsatisfactory charge during continuous use tends to occur. In addition, Cu ferrite containing Zn is preferable because the saturation magnetization is high, but a suitable selection may be made that matches the process of the image forming apparatus 100. Resins that cover the magnetic carrier are not particularly limited, and examples include silicone resin, styrene-acrylic resin, fluorine-containing resin, and olefin resin. The manufacturing method may be conducted by dissolving the coating resin in a solvent, and coating this on the core by spraying in a fluid layer. After the resin particles have electrostatically adhered to the nuclear particles, thermal fusion is conducted, and the coated substance is thus obtained. The thickness of the resin to be coated is 0.05 to 10 μm, preferably 0.3 to 4 μm.

According to the present invention as described above, the generation of filming can be prevented by the simplest possible configuration even if multiple photosensitive member linear velocities are provided and the AC frequency of the charge apparatus is fixed.

Various modifications will become possible for those skilled in the art after receiving the teachings of the present disclosure without departing from the scope thereof.

What is claimed is:

1. An image forming apparatus having a plurality of photosensitive member linear velocities, comprising:

a charge apparatus that charges by uniformly superimposing on a photosensitive member an alternate current bias voltage with a fixed frequency over a direct current bias voltage as the charge bias voltage;

an exposure apparatus that exposes the surface of the charged photosensitive member based on image data, and writes a latent image;

a developing apparatus that supplies toner to and makes visible the latent image formed on the surface of the photosensitive member;

a transfer apparatus that transfers the visible image on the photosensitive member to a transfer medium; and a cleaning apparatus that cleans the surface of the photosensitive member after transfer, wherein the image forming apparatus comprises a filming removal mode that removes filming on the surface of the photosensitive member; and the filming removal mode is selected corresponding to the plurality of photosensitive member linear velocities.

2. The image formation apparatus as claimed in claim 1, wherein the filming removal mode removes filming by applying toner onto the photosensitive member.

3. The image formation apparatus as claimed in claim 1, wherein the filming removal mode removes filming by lowering an AC alternate current charge current.

4. The image formation apparatus as claimed in claim 1, wherein during low linear velocity an execution frequency of the filming removal mode is more often than during high linear velocity.

5. The image formation apparatus as claimed in claim 1, wherein the charge apparatus has a charge roller.

6. The image formation apparatus as claimed in claim 1, wherein a brush-shaped roller is provided, and the brush-shaped roller is configured to rub against and scrap off a lubricant molded body, and then coat the same on the photosensitive member.

7. The image formation apparatus as claimed in claim 6, wherein the lubricant is a fatty acid metal salt or fluorinated particles.

8. The image formation apparatus as claimed in claim 1, wherein the toner used in the developing apparatus has a volume average particle diameter of 3 to 8 μm, and a ratio (Dv/Dn) of a volume average particle diameter (Dv) and a number average particle diameter (Dn) is in the range of 1.00 to 1.40.

9. The image formation apparatus as claimed in claim 1, wherein the toner used in the developing apparatus has a shape factor SF-1 in the range of 100 to 180, and a shape factor SF-2 in the range of 100 to 180.

10. The image formation apparatus as claimed in claim 1, wherein the toner used in the developing apparatus is a toner obtained by conducting a crosslinking and/or elongation reaction in a water medium on a toner material solution in which at least a polyester prepolymer having a functional group containing a nitrogen atom, a polyester, a colorant and a releasing agent are dispersed in an organic solvent.

11. The image formation apparatus as claimed in claim 1, wherein the toner used in the developing apparatus has a substantially spherical shape; the shape is stipulated by major axis r1, minor axis r2, and width r3 (here, let r1≧r2≧r3); the ratio between the major axis and minor axis (r2/r1) is in the range of 0.5 to 1.0; and the ratio between the width and minor axis (r3/r2) is in the range of 0.7 to 1.0.

12. A toner supplied in the developing process of an image forming apparatus of an electronic copier system, wherein a volume average particle diameter is 3 to 8 μm, and a ratio (Dv/Dn) of the volume average particle diameter (Dv) and a number average particle diameter (Dn) is in the range of 1.00 to 1.40;

the image forming apparatus having a plurality of photosensitive member linear velocities and comprising:

a charge apparatus that charges by uniformly superimposing on a photosensitive member an alternate current bias voltage with a fixed frequency over a direct current bias voltage as the charge bias voltage;

an exposure apparatus that exposes the surface of the charged photosensitive member based on image data, and writes a latent image;

a developing apparatus that supplies toner to and makes visible the latent image formed on the surface of the photosensitive member;

a transfer apparatus that transfers the visible image on the photosensitive member to a transfer medium; and a cleaning apparatus that cleans the surface of the photosensitive member after transfer, wherein the image forming apparatus comprises a filming removal mode that removes filming on the surface of the photosensitive member; and the filming removal mode is selected corresponding to the plurality of photosensitive member linear velocities.

13. The toner as claimed in claim 12, wherein the toner has a shape factor SF-1 in the range of 100 to 180, and a shape factor SF-2 in the range of 100 to 180.

14. The toner as claimed in claim 12, wherein the toner is obtained by conducting a crosslinking andlor elongation reaction in a water medium on a toner material solution in which at least a polyester prepolymer having a functional group containing a nitrogen atom, a polyester, a colorant and a releasing agent are dispersed in an organic solvent.

15. The toner as claimed in claim 12, wherein the toner has a substantially spherical shape; the shape is stipulated by major axis r1, minor axis r2, and width r3 (here, let r1≧r2≧r3); the ratio between the major axis and minor axis (r2/r1) is in the range of 0.5 to 1.0; and the ratio between the width and minor axis (r3/r2) is in the range of 0.7 to 1.0.

* * * * *